US010919324B2

(12) United States Patent
Komiya

(10) Patent No.: US 10,919,324 B2
(45) Date of Patent: Feb. 16, 2021

(54) PLATEN UNIT

(71) Applicant: BROTHER KOGYO KABUSHIKI KAISHA, Nagoya (JP)

(72) Inventor: Hidekazu Komiya, Nagoya (JP)

(73) Assignee: BROTHER KOGYO KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 16/694,593

(22) Filed: Nov. 25, 2019

(65) Prior Publication Data

US 2020/0086665 A1 Mar. 19, 2020

Related U.S. Application Data

(63) Continuation of application No. 15/717,356, filed on Sep. 27, 2017, now Pat. No. 10,518,559.

(30) Foreign Application Priority Data

Dec. 12, 2016 (JP) ..... JP2016-240091

(51) Int. Cl.

| | |
|---|---|
| ***B41F 15/18*** | (2006.01) |
| ***B41J 11/02*** | (2006.01) |
| ***B41J 2/01*** | (2006.01) |
| ***B41J 13/10*** | (2006.01) |
| ***B41J 3/407*** | (2006.01) |
| ***B41J 11/06*** | (2006.01) |

(52) U.S. Cl.

CPC ..... *B41J 11/02* (2013.01); *B41J 2/01* (2013.01); *B41J 3/4078* (2013.01); *B41J 11/06* (2013.01); *B41J 13/10* (2013.01)

(58) Field of Classification Search

CPC ..... B41J 11/14; B41J 11/06; B41J 3/4078

See application file for complete search history.

(56) References Cited

U.S. PATENT DOCUMENTS

| | | | |
|---|---|---|---|
| 7,413,301 | B2 | 8/2008 | Niimi et al. |
| 2003/0197750 | A1 | 10/2003 | Iwatsuki et al. |
| 2004/0179047 | A1 | 9/2004 | Niimi |
| 2004/0179081 | A1 | 9/2004 | Niimi et al. |
| 2013/0278698 | A1 | 10/2013 | Takeuchi et al. |

(Continued)

FOREIGN PATENT DOCUMENTS

| | | | |
|---|---|---|---|
| JP | 4089277 | B2 | 5/2008 |
| JP | 2013244615 | A | 12/2013 |
| JP | 2017-087585 | A | 5/2017 |

OTHER PUBLICATIONS

Extended European Search Report issued in connection with European Patent Application No. 17206795.1, dated Apr. 24, 2018. (9 pages).

*Primary Examiner* — Lam S Nguyen

(74) *Attorney, Agent, or Firm* — K&L Gates LLP

(57) ABSTRACT

A platen unit includes a platen, a mount portion, and a connection portion. The platen has a surface on which a print medium is to be placed. The mount portion is mounted on a platen support portion provided in a print device. The connection portion connects the mount portion and the platen such that a position of the platen is slidable, with respect to the mount portion, between a first position and a second position in a first direction and in a second direction. The first direction is a direction along the surface of the platen. The second position is located in the first direction with respect to the first position. The second direction is a direction opposite to the first direction.

11 Claims, 12 Drawing Sheets

(56) References Cited

U.S. PATENT DOCUMENTS

| | | | |
|---|---|---|---|
| 2013/0314483 | A1 | 11/2013 | Moriya et al. |
| 2015/0210094 | A1 | 7/2015 | Komiya |
| 2016/0257121 | A1 | 9/2016 | Komiya |
| 2017/0129262 | A1 | 5/2017 | Mashima |

PLATEN UNIT

CROSS-REFERENCE TO RELATED APPLICATION

This application is a Continuation Application of U.S. patent application Ser. No. 15/717,356 filed on Sep. 27, 2017, which claims priority to Japanese Patent Application No. 2016-240091 filed Dec. 12, 2016, the content of which is hereby incorporated herein by reference in its entirety.

BACKGROUND

The present disclosure relates to a platen unit that is configured to be attached to and removed from the print device.

In related art, a print device is proposed that is provided with a platen that supports a print medium such as a cloth from below and a head that discharges a liquid onto the print medium and that performs printing on the print medium using the liquid while causing the platen to move in a direction (a sub scan direction) perpendicular to a moving direction of the head (a main scan direction). In the print device of the related art, a user places the print medium onto the platen or removes the print medium from the platen in a state in which the platen is arranged in a set position located on an outer side of a case of the print device.

SUMMARY

In the print device of the related art, there may be a case in which an operation of placing and removing the print medium onto and from the platen may become complicated depending on an arrangement of the platen with respect to the case of the print device.

Embodiments of the broad principles derived herein provide a platen unit that is capable of improving user-friendliness when a user places and removes a print medium onto and from a platen.

Embodiments further provide a platen unit that includes a platen, a mount portion, and a connection portion. The platen has a surface on which a print medium is to be placed. The mount portion is mounted on a platenp support portion provided in a print device. The connection portion connects the mount portion and the platen such that a position of the platen is slidable, with respect to the mount portion, between a first position and a second position in a first direction and in a second direction. The first direction is a direction along the surface of the platen. The second position is located in the first direction with respect to the first position. The second direction is a direction opposite to the first direction.

BRIEF DESCRIPTION OF THE DRAWINGS

Embodiments will be described below in detail with reference to the accompanying drawings in which.

DETAILED DESCRIPTION

Figure 1:
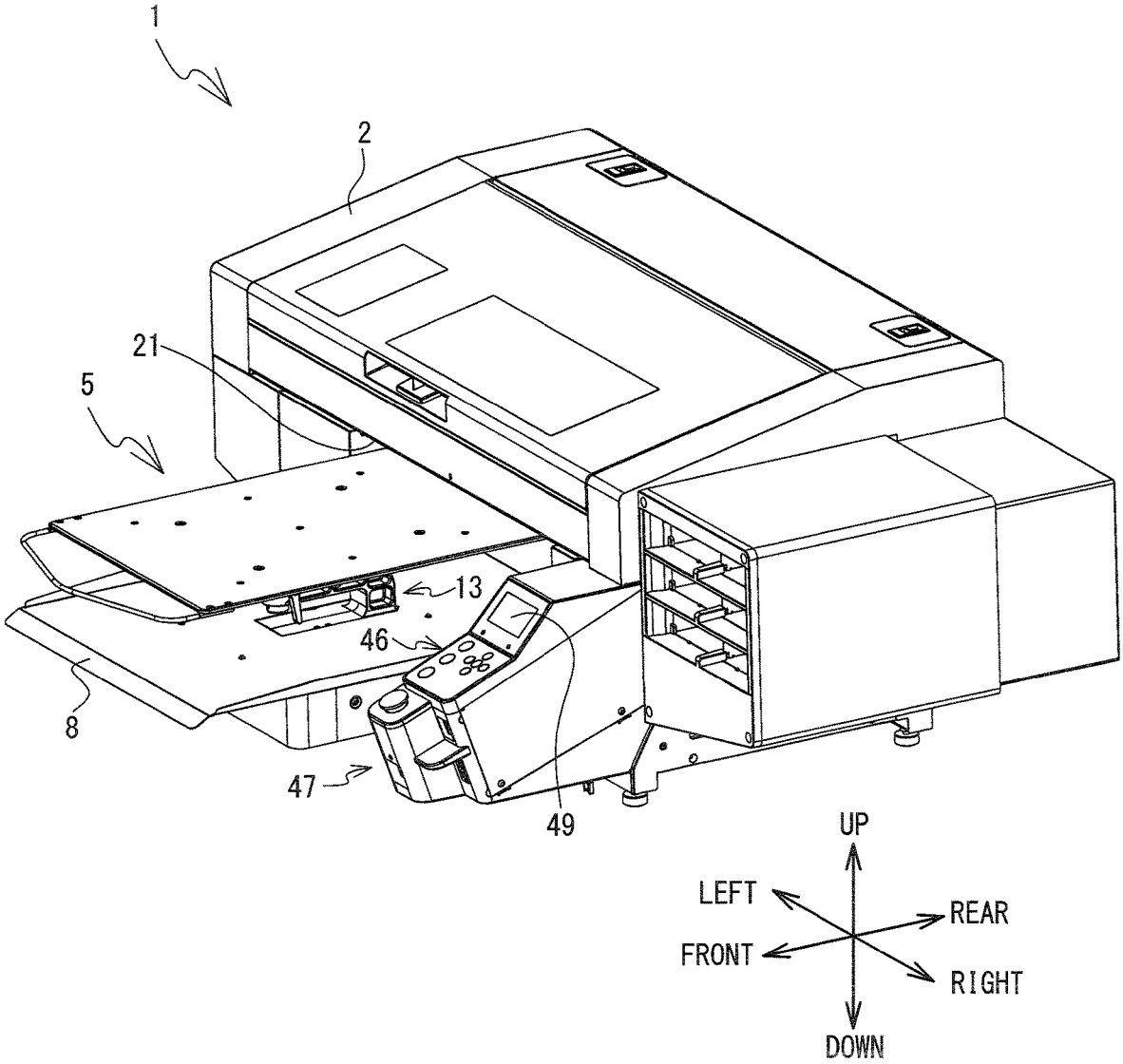
FIG. 1 is a perspective view of a print device.

A configuration of a print device 1 will be described with reference to FIGS. 1 to 10. An upward direction, a downward direction, a lower left direction, an upper right direction, a lower right direction, and an upper left direction in FIG. 1 respectively correspond to an upward direction, a downward direction, a frontward direction, a rearward direction, a rightward direction, and a leftward direction of the print device 1.

Mechanical Configuration of Print Device 1

The print device 1 is an inkjet printer that performs printing on a print medium (not shown in the drawings), which includes a cloth such as a T-shirt, paper, and the like, by discharging a liquid from head units 100 and 200 onto the print medium. For example, the print device 1 prints a color image on the print medium by downwardly discharging five mutually different types of inks (white (W), black (K), yellow (Y), cyan (C), and magenta (M)) as the liquid. In the explanation below, of the five types of ink, the white ink will be referred to as a white ink, and the four other inks, namely, the black, cyan, yellow, and magenta inks will be collectively referred to as color inks.

Figure 2:
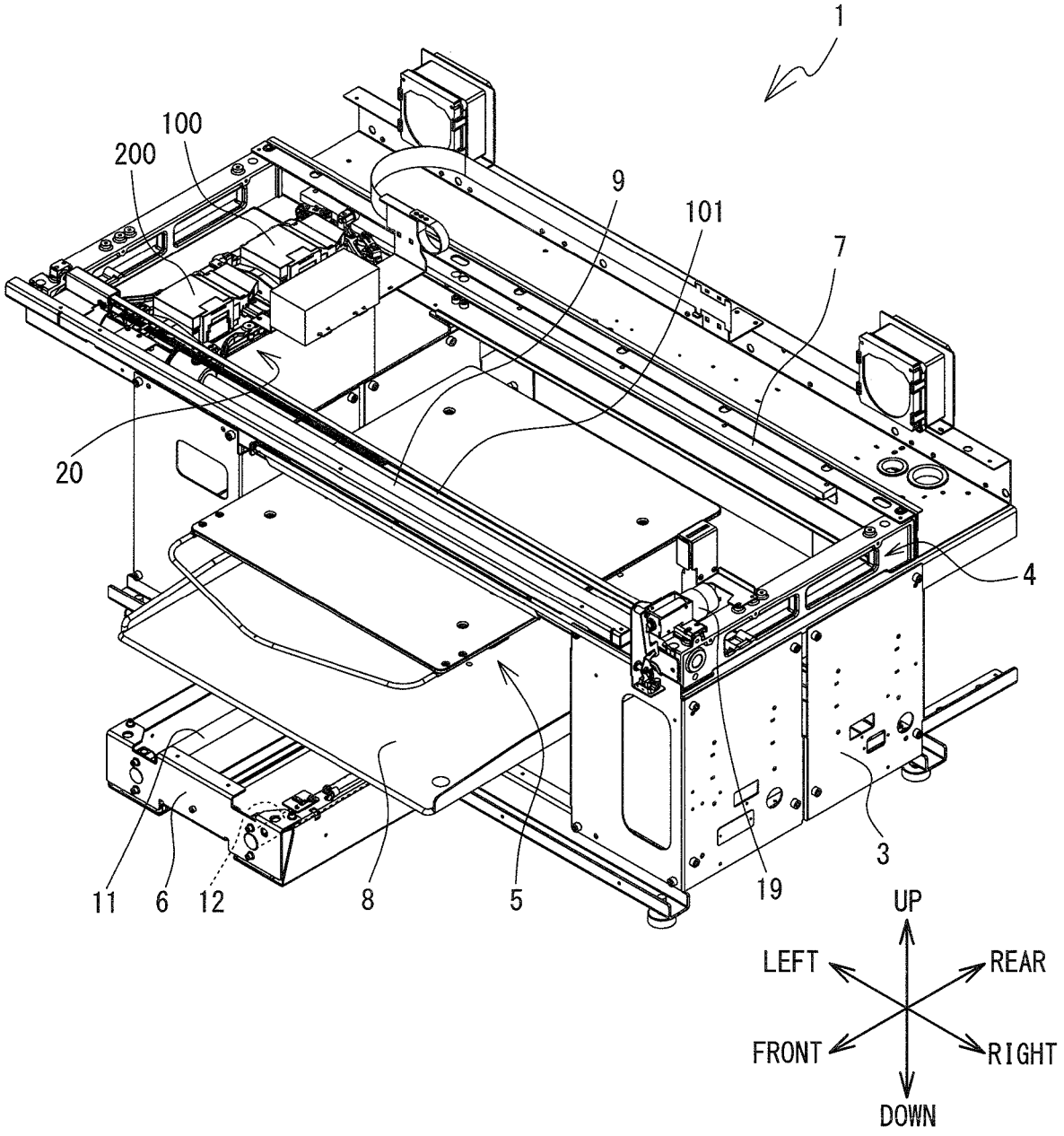
FIG. 2 is a perspective view of the print device from which a case is removed.

As shown in FIGS. 1 and 2, the print device 1 is provided with a case 2, a base portion 3, a frame body 4, a guide shaft 9, a rail 7, a carriage 20, the head units 100 and 200, a drive belt 101, a drive motor 19, a platen drive mechanism 6, a platen unit 5, and a tray 8.

As shown in FIGS. 1 to 4, the case 2 is a box shape that has openings 21 and 22 respectively in the front surface and the rear surface of the case 2. The case houses the head units 100 and 200. An operating portion 47 is provided in a position located on the front right side of the case 2. The operating portion 47 is provided with a display 49 and operation buttons 46. The operation buttons 46 are operated when a user inputs commands relating to various operations of the print device 1. The display 49 is a liquid crystal display (LCD) that can display various pieces of information. A sensor 18 is provided in the vicinity of the opening 21 of the case 2.

The base portion 3 and the frame body 4 are housed inside the case 2. The frame body 4 has a substantially rectangular frame shape in a plan view and is provided in an upper part of the base portion 3. The frame body 4 supports the guide shaft 9 on the front side and the rail 7 on the rear side of the frame body 4. The guide shaft 9 extends in the left-right direction inside the frame body 4. The rail 7 is provided so as to face the guide shaft 9 and extends in the left-right direction.

Figure 3:
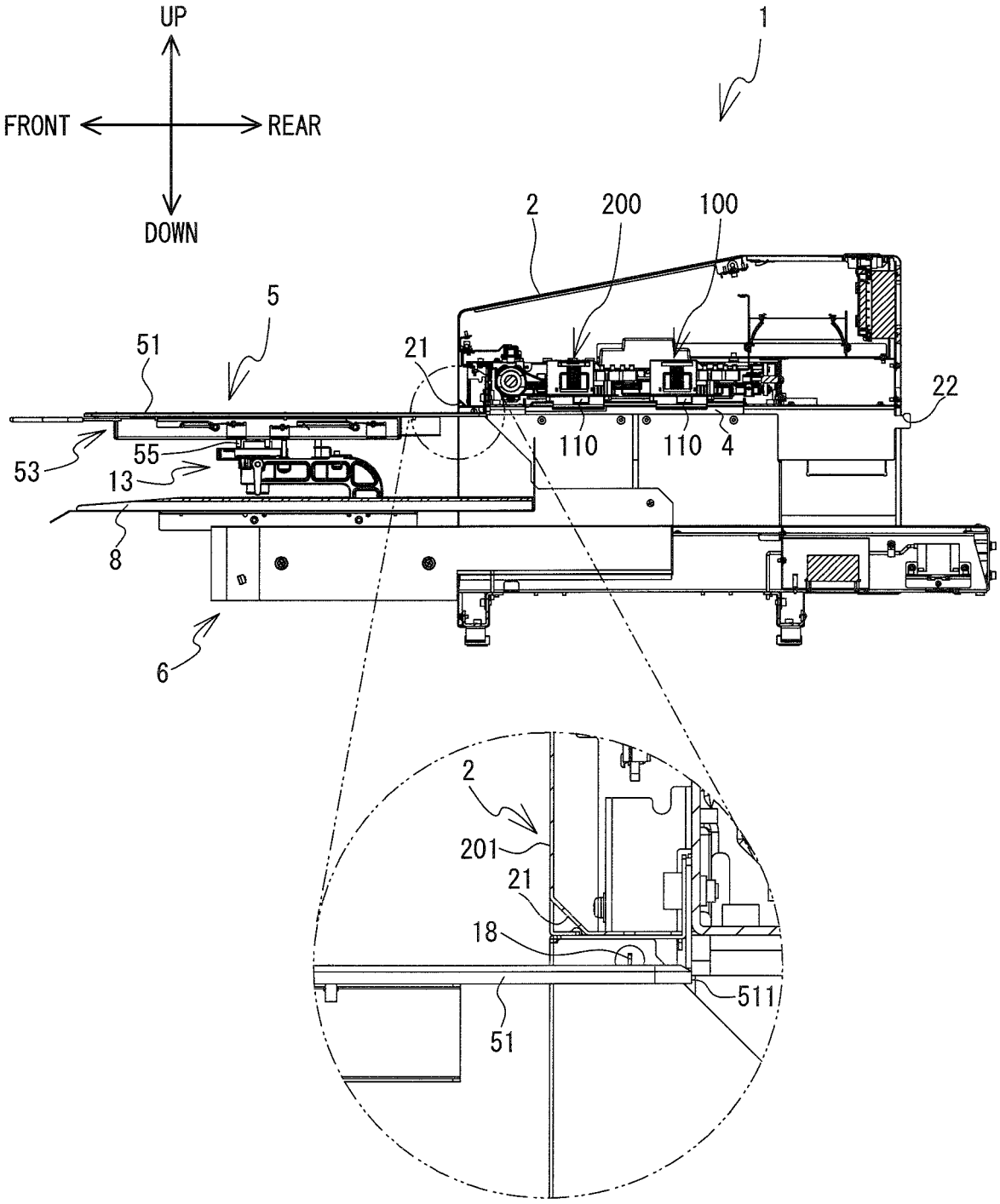
FIG. 3 is a cross-sectional view of the print device when a platen support base is in a set position and a platen is in a first position.
Figure 4:
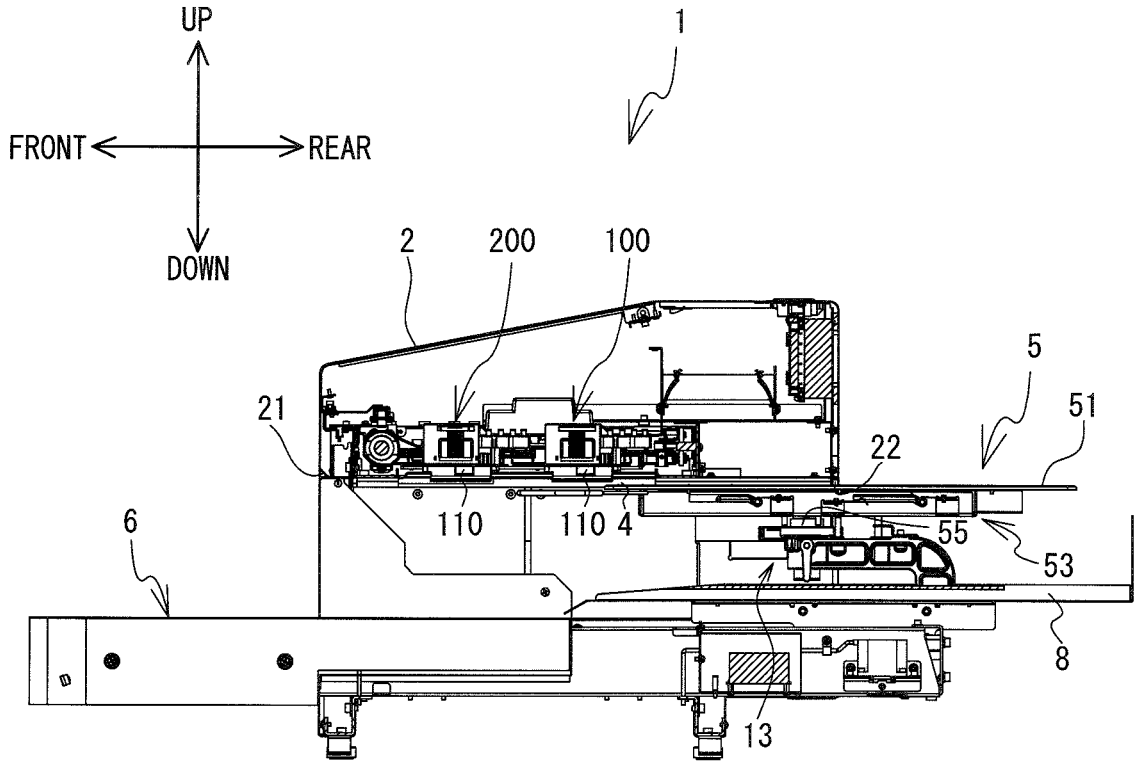
FIG. 4 is a cross-sectional view of the print device when the platen support base is in a print position and the platen is in the first position.

The carriage 20 is supported so as to be able to be conveyed in the left-right direction along the guide shaft 9. As shown in FIGS. 2 to 4, the head units 100 and 200 are mounted on the carriage 20 so as to be arranged side by side in the front-rear direction. The head unit 100 is positioned further to the rear than the head unit 200. As shown in FIGS.

3 and 4, a head 110 is provided in a lower part of each of the head units 100 and 200. The heads 110 can discharge the liquid onto the print medium. The head 110 of the head unit 100 discharges the white ink, and the head 110 of the head unit 200 discharges the color inks.

The drive belt 101 is suspended over the inner side of the frame body 4 along the left-right direction. The drive motor 19 is connected to the carriage 20 via the drive belt 101. The carriage 20 reciprocates in the left-right direction (a main scan direction) along the guide shaft 9 as a result of the drive motor 19 driving the drive belt 101.

The platen drive mechanism 6 is provided with a pair of guide rails 11 and 12 and a platen support base 13. The pair of guide rails 11 and 12 extend in the front-rear direction and support the platen support base 13 such that the platen support base 13 can move in the front-rear direction (a sub scan direction). The pair of guide rails 11 and 12 is inserted into the openings 21 and 22 and penetrates through the case 2. The platen support base 13 supports the platen unit 5. The platen support base 13 of a present embodiment removably supports the platen unit 5. The platen support base 13 can move between a print position and a set position, which will be described below, as a result of the driving of the platen drive mechanism 6.

The platen unit 5 is a unit on which the print medium is to be placed. The platen unit 5 will be explained in detail below. The tray 8 is provided below the platen unit 5. When the user places a T-shirt or the like on the platen unit 5, the tray 8 protects the T-shirt or the like by receiving the sleeves or the like of the T-shirt, such that the sleeves or the like do not come into contact with other components provided inside the case 2.

Figure 5:
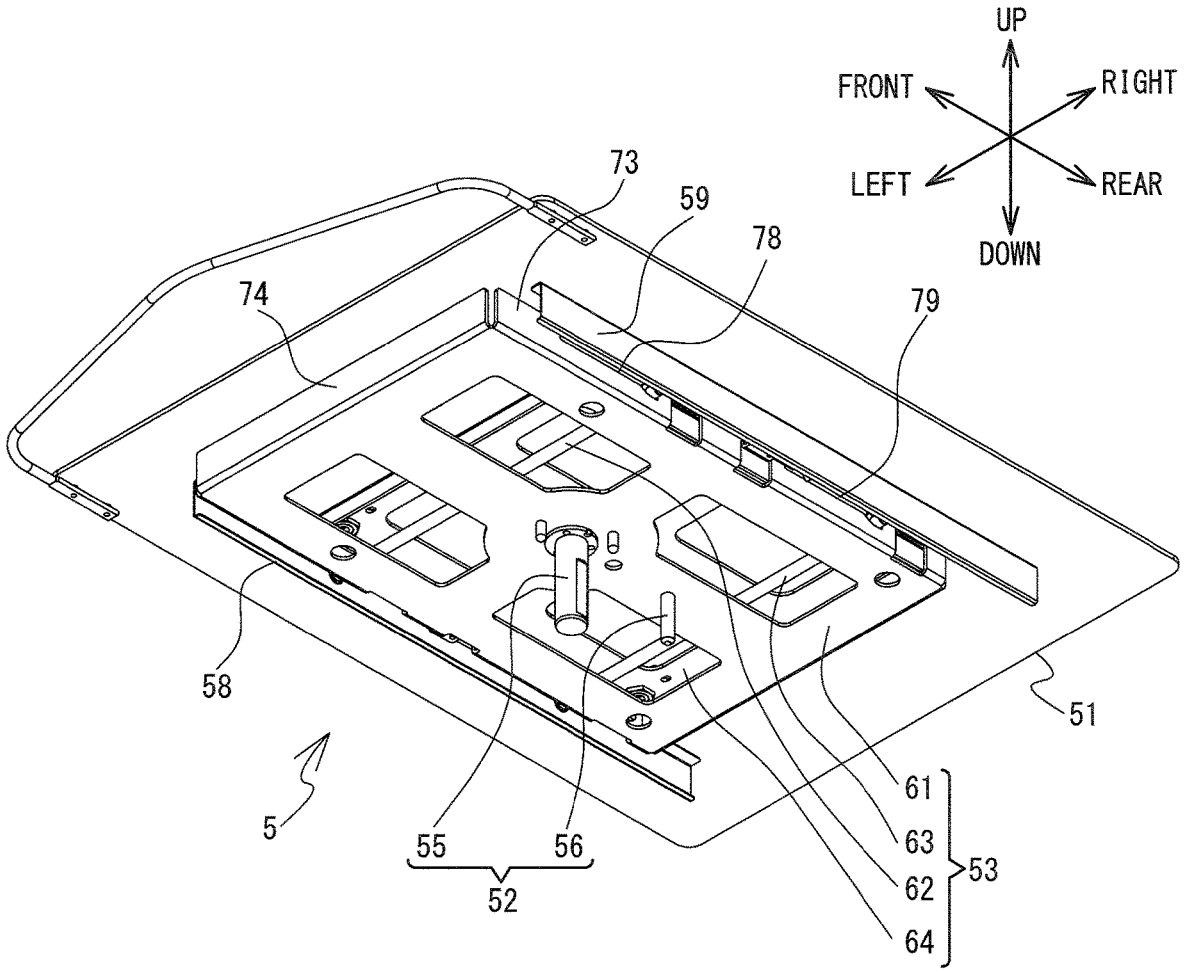
FIG. 5 is a perspective view of a platen unit.
Figure 6:
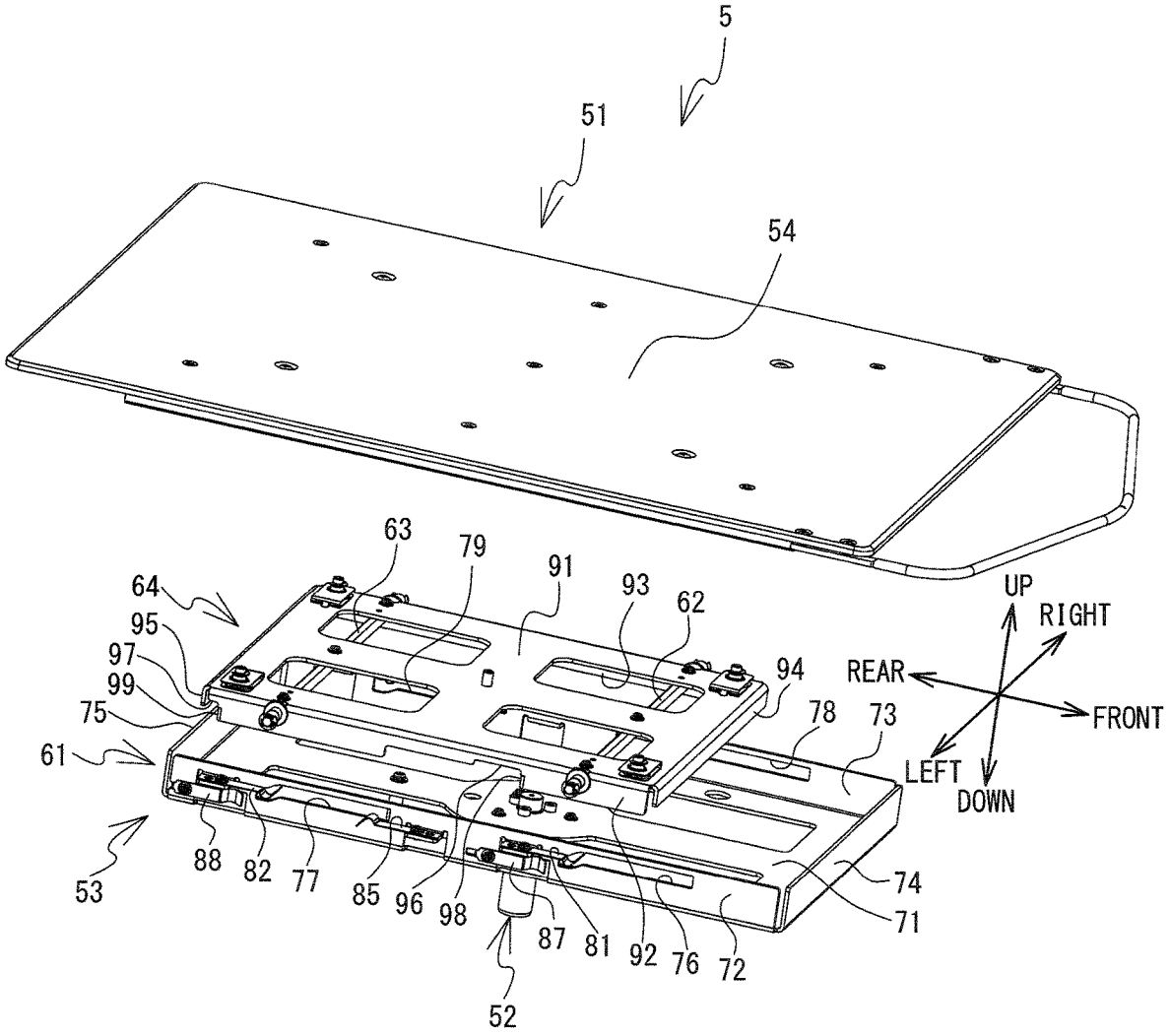
FIG. 6 is an exploded view of the platen unit.
Figure 7:
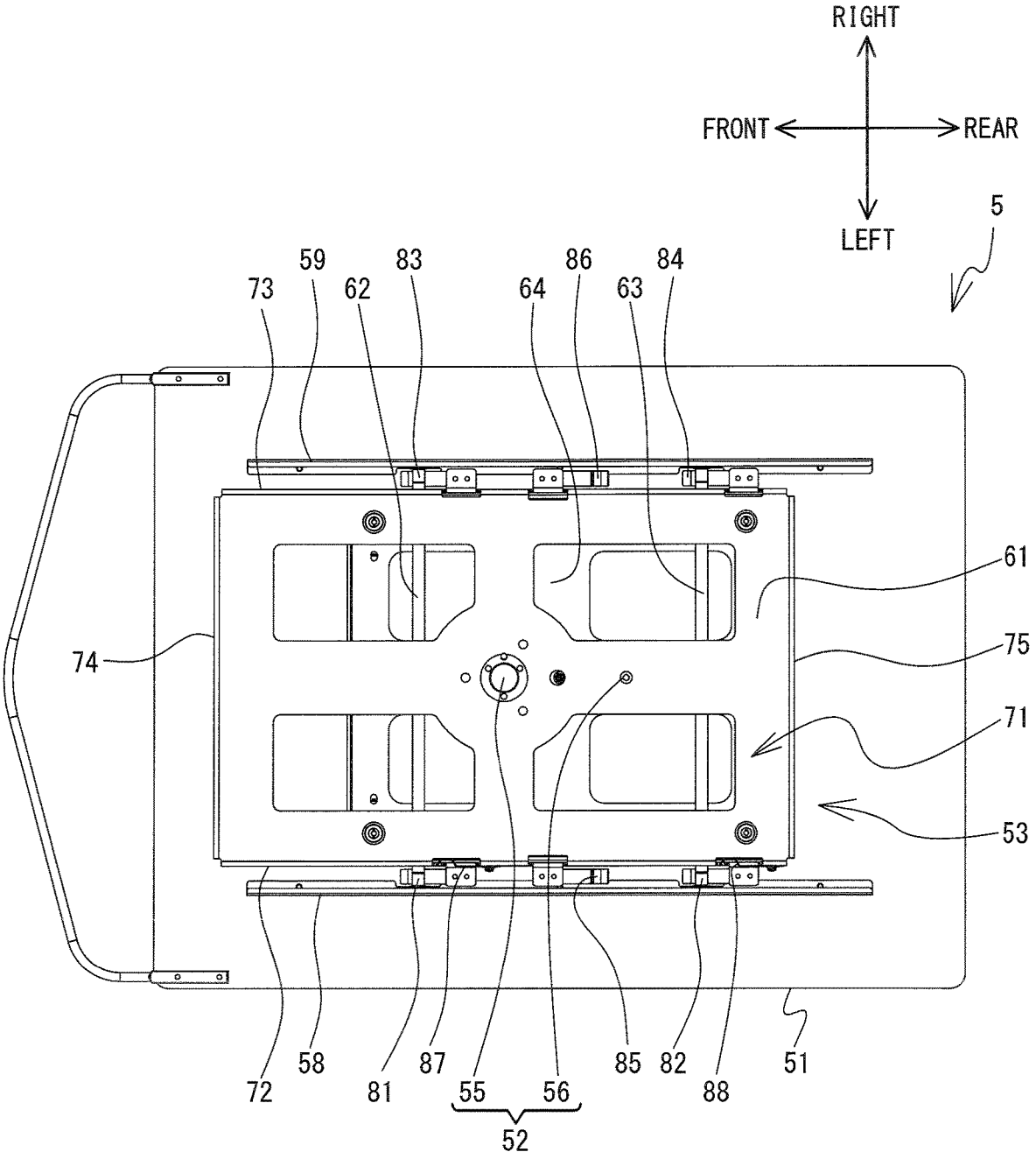
FIG. 7 is a bottom view of the platen unit.

An example of the platen unit 5 will be explained with reference to FIGS. 5 to 8. As shown in FIGS. 5 to 7, the platen unit 5 is provided with a platen 51, a mount portion 52, and a connection portion 53. The platen 51 is provided with a first surface 54 on which the print medium is to be placed. The first surface 54 is the upper surface of the platen 51 and is a flat surface extending in the front-rear direction and the left-right direction. The platen 51 of the present embodiment is formed in a rectangular plate-like shape with the longitudinal direction thereof being the frontward direction. When print processing is performed, the print medium is placed on the platen 51, and the platen 51 is conveyed in the sub scan direction. Therefore, the print medium is also conveyed in the sub scan direction. As a result, the platen 51 is conveyed to the print position, which faces the heads 110, together with the print medium placed on the first surface 54. The mount portion 52 is a portion that is mounted on the platen support base 13. The mount portion 52 of the present embodiment is provided on the opposite side to the first surface 54 of the platen 51. The mount portion 52 includes two cylindrical rods 55 and 56. Each of the rods 55 and 56 extends in a substantially perpendicular direction with respect to the first surface 54 of the platen 51. The rod 55 is provided in the vicinity of the center of gravity of the platen 51, for example. The rod 56 is provided to the rear of the rod 55. The rod 55 is fixed as a result of being inserted into an insertion hole provided in an upper part of the platen support base 13. Since the position of the rod 56 with respect to the rod 55 is fixed by the platen support base 13, the rod 56 regulates the rotational movement of the platen 51 around the rod 55. As a result, the platen unit 5 is mounted on the platen support base 13 in a state in which the position of the platen unit 5 is fixed with respect to the platen support base 13 by the rods 55 and 56.

The connection portion 53 connects the mount portion 52 and the platen 51 such that the position of the platen 51 with respect to the mount portion 52 can be changed between a first position and a second position. The second position is a different position from the first position with respect to a position in the direction along the first surface 54, namely, with respect to a position in at least one of the front-rear direction and the left-right direction. The connection portion 53 of the present embodiment connects the mount portion 52 and the platen 51 such that the platen 51 can slide with respect to the mount portion 52 between the first position and the second position in the front-rear direction. For example, the connection portion 53 connects the mount portion 52 and the platen 51 in a state in which the overall length of the platen unit 5 in the frontward direction is kept constant at the first position and the second position. The second position is located further to the front than the first position.

Figure 8:
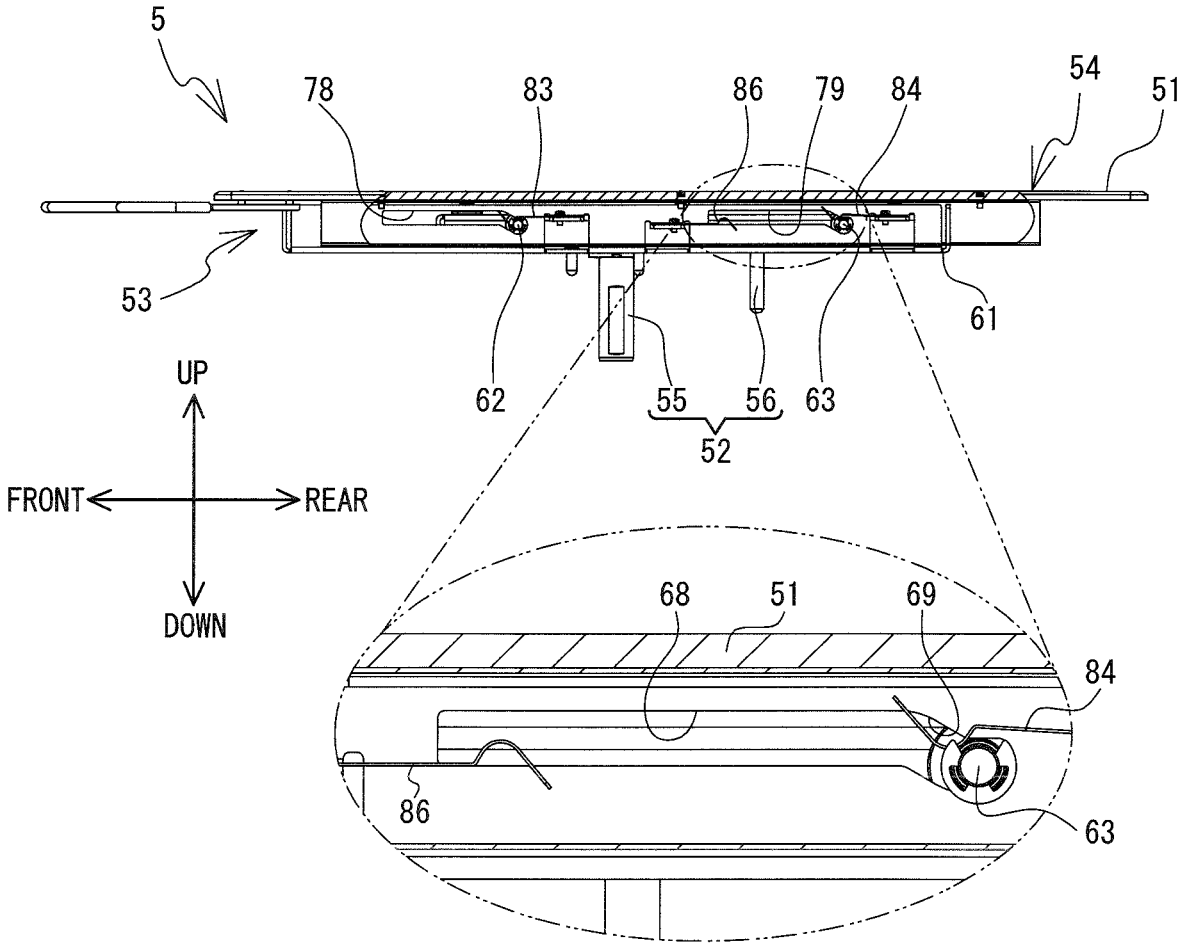
FIG. 8 is a cross-sectional view of the platen unit when the platen is in the first position.

The connection portion 53 includes a first fixed portion 61, guide members 62 and 63, and a second fixed portion 64, for example. The first fixed portion 61 is provided with grooves 76 to 79 extending in the frontward direction. The first fixed portion 61 is fixed to one of the mount portion 52 or the platen 51. In the present embodiment the first fixed portion 61 is fixed to the mount portion 52. The first fixed portion 61 is a box shape that is open on the platen 51 side (the upper side). The first fixed portion 61 is provided with a main body portion 71 that is substantially parallel to the first surface 54 of the platen 51, a pair of left and right wall portions 72 and 73 provided so as to extend from the main body portion 71 to the platen 51 side, and a pair of front and rear wall portions 74 and 75. The main body portion 71 is fixed to an upper end portion of the mount portion 52. The pair of left and right wall portions 72 and 73 extends in the frontward direction. The pair of front and rear wall portions 74 and 75 extends in the left-right direction. The wall portion 72 is provided with the grooves 76 and 77 that are lined up in the frontward direction. The wall portion 73 is provided with the grooves 78 and 79 that are lined up in the frontward direction. The grooves 76 to 79 may be through-holes having the same shape as each other. As shown in FIG. 8, each of the grooves 76 to 79 includes a straight line portion 68 and an inclined portion 69. The rear end of the straight line portion 68 is connected to the front end of the inclined portion 69. The straight line portion 68 extends in the frontward direction. The inclined portion 69 extends in an intersecting direction that intersects the first surface 54 of the platen 51, and in the frontward direction. The intersecting direction of the present embodiment is a direction perpendicular to the first surface 54, namely, the up-down direction. The inclined portion 69 extends in a direction combining the front direction and the intersecting direction, namely, in a direction extending diagonally forward and upward from the rear end of each of the grooves 76 to 79. The grooves 76 and 77 respectively face the grooves 78 and 79. The grooves 76 and 77 are respectively provided in the same position as the grooves 78 and 79 in the front-rear direction.

As shown in FIGS. 5 to 7, the guide members 62 and 63 are rod members extending in a direction that intersects with the frontward direction. The guide members 62 and 63 are lined up so as to respectively correspond to the grooves 76 and 77 that are lined up in the frontward direction. A left end portion of the guide member 62 is inserted into the groove 76, and a right end portion of the guide member 62 is inserted into the groove 78. A left end portion of the guide member 63 is inserted into the groove 77, and a right end portion of the guide member 63 is inserted into the groove 79. The guide members 62 and 63 guide the movement of the platen 51 with respect to the mount portion 52.

The second fixed portion 64 supports the guide members 62 and 63. The second fixed portion 64 is fixed to the other of the mount portion 52 or the platen 51. In the present embodiment, the second fixed portion 64 is fixed to the platen 51. The second fixed portion 64 is a box shape that is open on the mount portion 52 side (the lower side). The second fixed portion 64 is provided with a main body portion 91 that is substantially parallel to the first surface 54 of the platen 51, a pair of left and right wall portions 92 and 93 that are provided so as to extend from the main body portion 91 to the mount portion 52 side, and a pair of front and rear wall portions 94 and 95. The main body portion 91 is fixed to a surface on the opposite side to the first surface 54 of the platen 51. The wall portions 92 and 93 extend in the frontward direction. The wall portions 94 and 95 extend in the left-right direction. The second fixed portion 64 is provided on the inner side of the first fixed portion 61. The pair of left and right wall portions 92 and 93 respectively faces the wall portions 72 and 73 of the first fixed portion 61. The pair of front and rear wall portions 94 and 95 respectively faces the wall portions 74 and 75 of the first fixed portion 61. As shown in FIG. 6, the wall portion 92 is provided with notched portions 96 and 97 and chamfered portions 98 and 99. The notched portions 96 and 97 are portions obtained as a result of parts of the wall portion 92 extending in the frontward direction being cut off upwardly from the lower edge of the wall portion 92. The chamfered portions 98 and 99 are chamfered sections formed at the front ends of the notched portions 96 and 97, respectively.

The platen unit 5 includes first energizing members 81 to 84, second energizing members 85 and 86, and third energizing members 87 and 88. The first energizing members 81 and 84 energize the platen 51 in the downward direction, from the platen 51 toward the mount portion 52, when the position of the platen 51 with respect to the mount portion 52 is the first position. For example, the energizing members 81 and 83 energize the guide member 62 in the downward direction by coming into contact with the guide member 62, which is disposed in the first position, from above (from the platen 51 side). As a result, the first energizing members 81 and 83 energize the platen 51 in the downward direction via the second fixed portion 64 that supports the guide member 62. The first energizing members 82 and 84 energize the guide member 63 in the downward direction by coming into contact with the guide member 63, which is disposed in the first position, from above (from the platen 51 side). As a result, the first energizing members 82 and 84 energize the platen 51 in the downward direction via the second fixed portion 64 that supports the guide member 63. Each of the first energizing members 81 to 84 extends in the frontward direction and is a flat spring that is formed, in a side view, in a U-shape that is open in the upward direction.

The first energizing members 81 to 84 are respectively provided in the rear end portions of the grooves 76 to 79. Front end portions of the first energizing members 81 to 84 are disposed in positions that respectively overlap with the grooves 76 to 79 in the front-rear direction in a side view. Each of rear end portions of the first energizing members 81 to 84 is fixed to the first fixed portion 61. The first energizing members 81 and 83 are lined up in the left-right direction. The first energizing members 82 and 84 are lined up in the left-right direction. The first energizing members 81 and 82 are lined up in the frontward direction on the left side of the wall portion 72 of the first fixed portion 61 so as to respectively correspond to the guide members 62 and 63 that are lined up in the frontward direction. The first energizing members 83 and 84 are lined up in the frontward direction on the right side of the wall portion 73 of the first fixed portion 61 so as to respectively correspond to the guide members 62 and 63 that are lined up in the frontward direction. Each of the first energizing members 81 and 83 guides the movement of the guide member 62 using a part of the U-shaped bent portion on the free end side thereof, and energizes the guide member 62 disposed in the first position in the downward direction, using the restoring force of the U-shaped bent portion. Similarly, each of the first energizing members 82 and 84 guides the movement of the guide member 63 using a part of the U-shaped bent portion on the free end side thereof, and energizes the guide member 63 disposed in the first position in the downward direction, using the restoring force of the U-shaped bent portion.

The second energizing members 85 and 86 energize the platen 51 in the frontward direction when the position of the platen 51 with respect to the mount portion 52 is the second position. For example, each of the second energizing members 85 and 86 extend in the frontward direction and is a flat spring that is formed, in a side view, in a reverse U-shape that is open in the downward direction. The second energizing members 85 and 86 are lined up in the left-right direction. The second energizing members 85 and 86 are respectively provided in front end portions of the grooves 77 and 79, and energize left and right end portions of the guide member 63 disposed in the second position in both the frontward and upward directions. For example, each of the second energizing members 85 and 86 guides the movement of the guide member 63 over the straight line portion 68 using a part of a U-shaped bent portion on the free end side (front side) thereof, and energizes the guide member 63 disposed in the second position in the frontward and upward directions using the restoring force of the U-shaped bent portion.

The third energizing members 87 and 88 energize the platen 51 against the mount portion 52 in the left-right direction when the position of the platen 51 with respect to the mount portion 52 is the first position. For example, the third energizing members 87 and 88 energize the platen 51 against the mount portion 52 in the left-right direction by energizing the wall portion 92 of the second fixed portion 64 to the right when the position of the platen 51 with respect to the mount portion 52 is the first position. Each of the third energizing members 87 and 88 extends in the first direction and is a flat spring that is formed, in a plan view, in a U-shape that is open in the leftward direction. The third energizing members 87 and 88 are respectively provided below and to the rear of rear end portions of the grooves 76 and 77. The third energizing members 87 and 88 are lined up in the frontward direction on the left side of the wall portion 72 of the first fixed portion 61. The third energizing members 87 and 88 are provided only on one side (the left side) of the second fixed portion 64 in the left-right direction. The third energizing members 87 and 88 each energize the wall portion 92 of the second fixed portion 64 disposed in the first position in the left-right direction, using the restoring force of the U-shaped bent portion of the third energizing members 87 and 88.

The platen unit 5 further includes a pair of left and right correcting members 58 and 59. The correcting members 58 and 59 correct twisting of the platen 51 in the frontward direction. For example, the correcting members 58 and 59 extend in the front direction and are members formed in a concave shape with openings in a direction mutually facing each other. The correcting members 58 and 59 are formed of a material (a metal material, for example) having a higher rigidity than that of the platen 51 and are less likely to deform than the platen 51. The correcting members 58 and 59 are fixed to the surface on the opposite side to the first surface 54 of the platen 51, and inhibit the platen 51 from being twisted in the frontward direction. The correcting members 58 and 59 are disposed further away from the center of the platen 51 in the left-right direction than the first fixed portion 61 and the second fixed portion 64 respectively. The configuration of the correcting members 58 and 59 may be changed as appropriate. For example, the lower ends of the correcting members 58 and 59 may be disposed so as to be lower than the first fixed portion 61 and may cover end portions of the first fixed portion 61 in the left-right direction.

Print Position and Set Position

With reference to FIGS. 3 and 4, the print position and the set position, which are located within a movable range of the platen support base 13, will be explained. The print position is a position in which the printing is to be performed on the print medium as a result of the liquid being discharged from the heads 110. The set position is a position in which the print medium is to be placed onto the platen 51 of the platen unit 5 or to be removed from the platen 51 of the platen unit 5. An example of the print position and the set position will be explained below. The print position is a position illustrated in FIG. 4 in which the platen 51 supported by the platen support base 13 faces the heads 110. In the print position, at least part of the platen support base 13 is disposed inside the case 2. The removable position is a position shown in FIG. 3 in which the platen support base 13 reaches front end portions of the guide rails 11 and 12. In the set position, the platen support base 13 is disposed outside the case 2, and the front end of the platen 51 is disposed outside the case 2. The set position is located further to the front than the print position.

Slide Operation of Platen Unit 5

A slide operation of the platen 51 between the first position and the second position will be explained with reference to FIGS. 3 and 8 to 10. In a state in which the platen unit 5 is supported by the platen support base 13, the connection portion 53 connects the mount portion 52 and the platen 51. For example, the connection portion 53 connects the mount portion 52 and the platen 51 such that, when the platen support portion 13 is in the set position, a gap between the platen 51 and the case 2 in the front-rear direction is changeable in accordance with the position of the platen 51 with respect to the mount portion 52. For example, the connection portion 53 connects the mount portion 52 and the platen 51 such that the platen 51 can slide with respect to the mount portion 52 in the front-rear direction between the first position and the second position. Since the connection portion 53 is provided with the grooves 76 to 79, each of which includes the straight line portion 68 and the inclined portion 69, the positions of the first position and the second position in the intersecting direction, which intersects the first surface 54, are different.

For example, the operation of sliding the position of the platen 51 with respect to the mount portion 52 between the first position and the second position is manually performed by the user in a state in which the platen support base 13, which supports the platen unit 5, is disposed in the set position. As shown in FIGS. 3 and 8, when the position of the platen 51 with respect to the mount portion 52 is in the first position, the guide member 62 is disposed in the rear end portions of the grooves 76 and 78. The guide member 62 comes into contact with the lower surfaces of the front end portions of the first energizing members 81 and 83, and is energized in the downward direction by the energizing members 81 and 83. Similarly, the guide member 63 is disposed in the rear end portions of the grooves 77 and 79, and is energized in the downward direction by the first energizing members 82 and 84. Since the guide member 63 is separated from the second energizing members 85 and 86, the guide member 63 is not energized by the second energizing members 85 and 86. The wall portion 92 of the second fixed portion 64 is energized by the third energizing members 87 and 88 in the rightward direction. However, the third energizing members 87 and 88 may energize the wall portion 92 in either the rightward direction or the leftward direction. As shown in FIG. 3, when the platen support base 13, which supports the platen unit 5, is disposed in the set position and the position of the platen 51 with respect to the mount portion 52 is the first position, a rear end portion 511 of the platen 51 is positioned inside the case 2. For example, it is sufficient that the rear end portion 511 of the platen 51 be positioned further toward the head 110 side in the front-rear direction than a front end portion 201 of the case 2. When a gap between the platen 51 and the case 2 in the front-rear direction is defined as a gap between the rear end portion 511 of the platen 51 and the front end 201 of the case 2, the gap between the platen 51 and the case 2 is zero when the position of the platen 51 with respect to the mount portion 52 is the first position. A state in which the gap between the platen 51 and the case 2 is zero also includes a state in which the rear end portion 511 of the platen 51 is disposed further to the rear direction side than the front end portion 201 of the case 2 in the front-rear direction, as well as a state in which the rear end portion 511 of the platen 51 is positioned in the same position as the front end portion 201 of the case 2 in the front-rear direction. Depending on the configuration of the print device 1, the gap between the platen 51 and the case 2 in the front direction may be defined with reference to other components, such as a gap between the rear end portion 511 of the platen 51 and the opening 21 of the case 2.

When the position of the platen 51 with respect to the mount portion 52 is slid from the first position to the second position, the user pulls the platen 51 in the frontward direction. When the platen 51 is pulled in the frontward direction, the guide member 62 resists the energizing force of the first energizing members 81 and 83, and after sliding in the frontward direction and the intersecting direction from the rear end portions of the grooves 76 and 78 along the inclined portions 69, the guide member 62 slides in the frontward direction along the straight line portions 68. Similarly, the guide member 63 resists the energizing force of the first energizing members 82 and 84, and after sliding in the frontward direction and the intersecting direction from the rear end portions of the grooves 77 and 79 along the inclined portions 69, the guide member 63 slides in the frontward direction along the straight line portions 68. When the wall portion 92 of the second fixed portion 64 is moved relatively together with the platen 51, the third energizing members 87 and 88 are guided by the chamfered portions 98 and 99 and reach the positions of the notched portions 96 and 97. As a result, the energizing in the left-right direction of the wall portion 92 of the fixed portion 64 by the third energizing members 87 and 88 is released.

Figure 9:
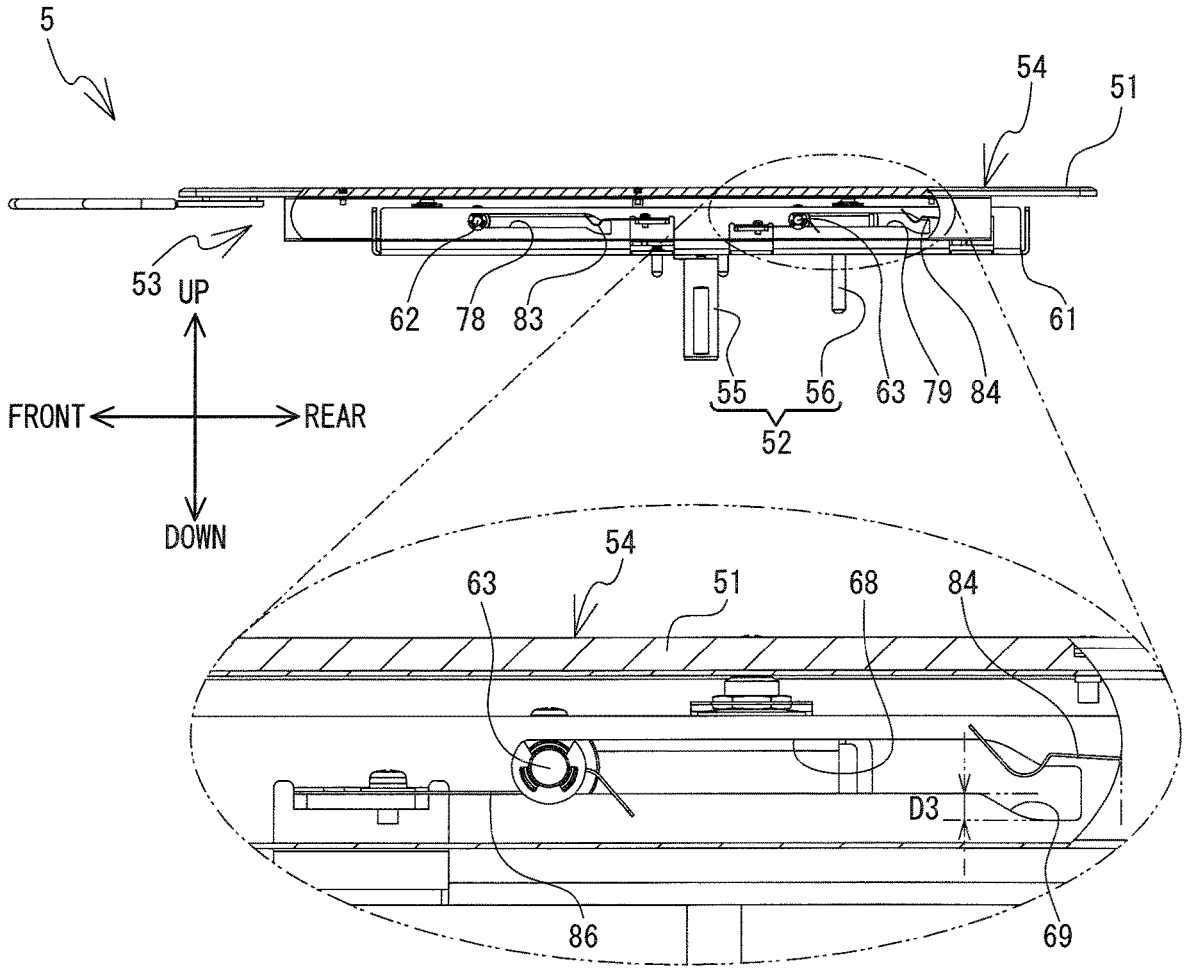
FIG. 9 is a cross-sectional view of the platen unit when the platen is in a second position.
Figure 10:
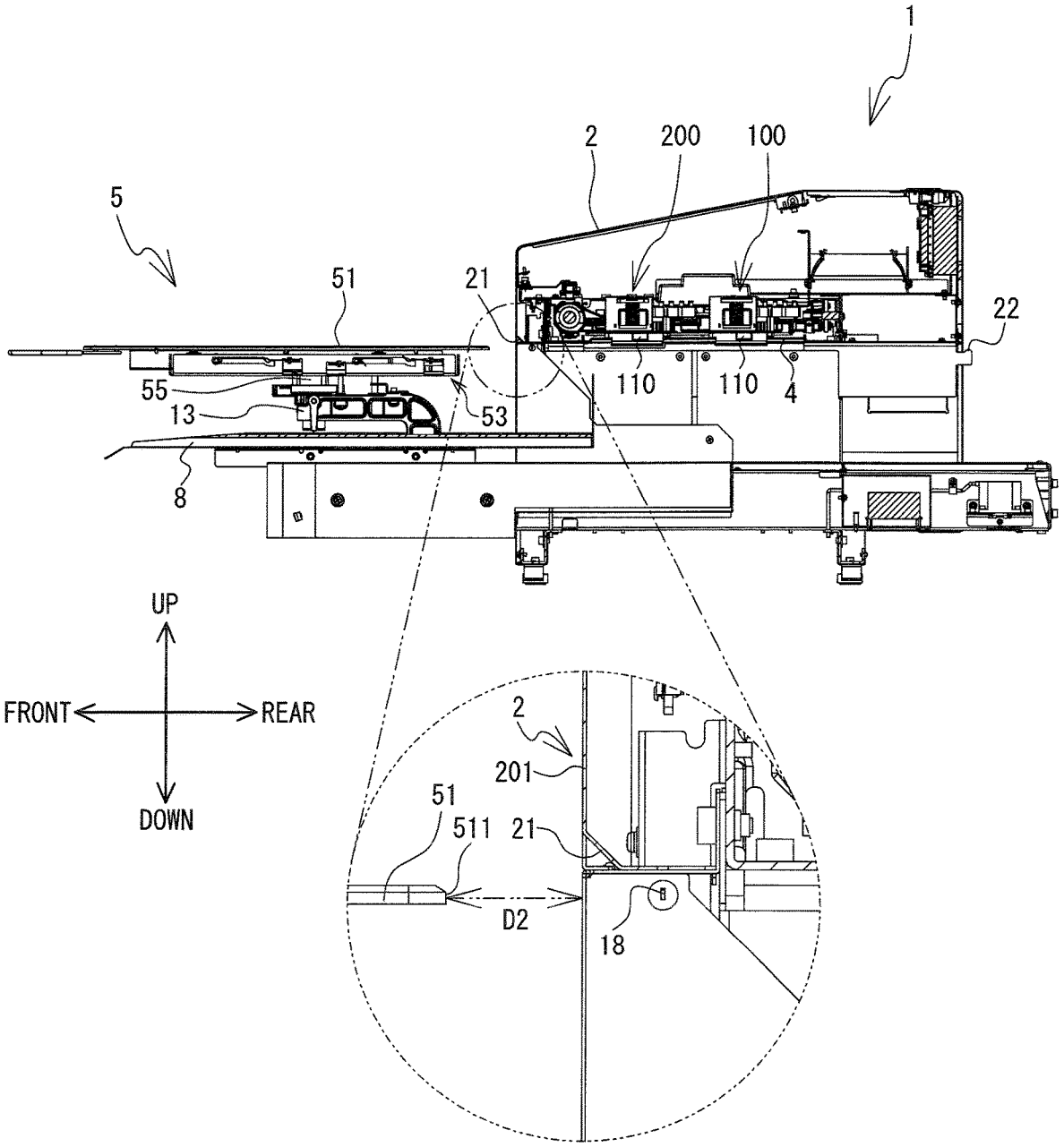
FIG. 10 is a cross-sectional view of the print device when the platen support base is in the set position and the platen is in the second position.

As shown in FIGS. 9 and 10, when the position of the platen 51 with respect to the mount portion 52 is the second position, the guide member 62 is disposed in the front end portions of the grooves 76 and 78 and is separated from the first energizing members 81 and 83. The guide member 62 is not energized by the first energizing members 81 and 83. Similarly, the guide member 63 is disposed in the front end portions of the grooves 77 and 79 and is separated from the first energizing members 82 and 84. The guide member 63 is not energized by the first energizing members 82 and 84. The guide member 63 comes into contact with the upper surface of the rear end portions of the second energizing members 85 and 86 and is energized in the frontward and upward directions by the second energizing members 85 and 86. The third energizing members 87 and 88 shown in FIG. 6 are respectively disposed in the notched portions 96 and 97 and are separated from the wall portion 92 of the second fixed portion 64. Therefore, the wall portion 92 of the second fixed portion 64 is not energized by the third energizing members 87 and 88. The connection portion 53 connects the mount portion 52 and the platen 51 such that the position of the platen 51 can be changed between the first position and the second position, which have mutually different positions in the intersecting direction that intersects with the first surface 54. The position of the straight line portion 68 in the up-down direction is located above the position of the rear end of the inclined portion 69 in the up-down direction, by a distance D3. Therefore, in the print device 1 of the present embodiment, the position of the platen 51 in the up-down direction when the platen 51 is in the second position is higher, by the distance D3, than the position of the platen 51 in the up-down direction when the platen 51 is in the first position. The sensor 18 is configured to output to a CPU 40 (refer to FIG. 11), which will be described later, a detection signal that indicates that the position of the platen 51 in the intersecting direction is the second position, which is different from that of the first position. The sensor 18 is an infrared sensor, for example, and is installed in a position that is approximately the distance D3 above the position of the platen 51 in the up-down direction, when the platen 51 is in the first position in the state in which the platen unit 5 is supported by the platen support base 13. Since the platen 51 does not pass through the detection range of the sensor 18 when the platen 51 is in the first position, the sensor 18 of the present embodiment does not output, to the CPU 40, the detection signal that indicates the platen 51 is in the second position. In addition to when the platen 51 is in the second position, the sensor 18 of the present embodiment outputs, to the CPU 40, the detection signal that indicates the platen 51 is in the second position when the guide members 62 and 63 are positioned on the straight line portions 68. The CPU 40 can detect that the platen 51 is in the second position and is not in the first positon on the basis of the detection signal output from the sensor 18.

As shown in FIG. 10, when the platen support base 13, which supports the platen unit 5, is disposed in the set position and the position of the platen 51 with respect to the mount portion 52 is the second position, the rear end portion 511 of the platen 51 is outside the case 2. The rear end portion 511 of the platen 51 is positioned further than the front end 201 of the case 2 to the side opposite to the head 110 side, in the front-rear direction. A gap D2 between the rear end portion 511 of the platen 51 and the front end portion 201 of the case 2 in the front-rear direction is greater than zero. In other words, as shown in FIGS. 3 and 10, in the state in which the platen unit 5 is supported by the platen support base 13 and the platen support base 13 is disposed in the set position, the gap between the platen 51 and the case 2 is larger when the position of the platen 51 with respect to the mount portion 52 is the second position than when the position of the platen 51 with respect to the mount portion 52 is the first position. Since an operation of sliding the position of the platen 51 with respect to the mount portion 52 from the second position to the first position is a reverse operation of the operation of sliding the position of the platen 51 from the first position to the second position, an explanation thereof is omitted herein.

Electrical Configuration of Print Device 1

Figure 11:
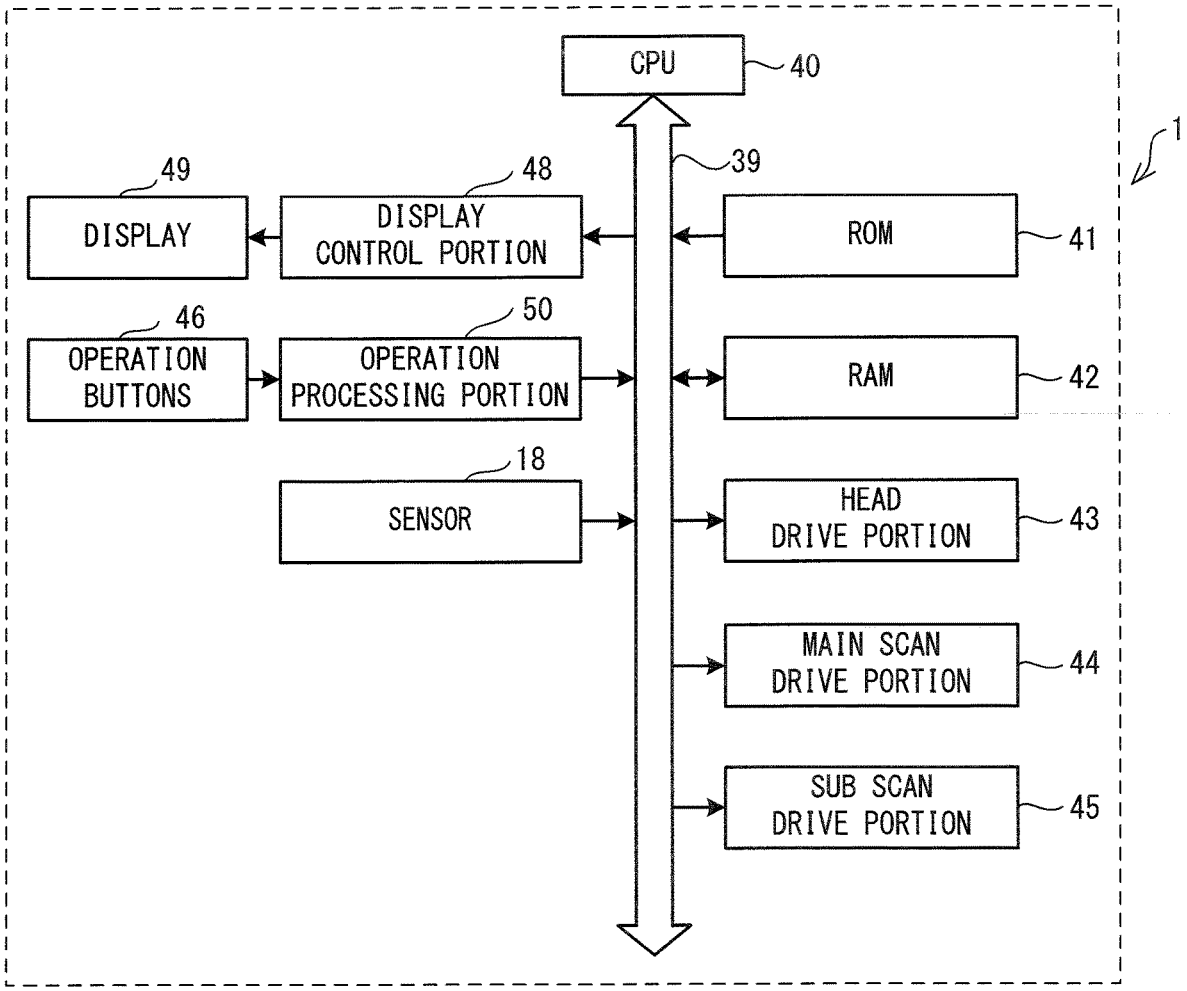
FIG. 11 is a block diagram showing an electrical configuration of the print device.

The electrical configuration of the print device 1 will be explained with reference to FIG. 11. The print device 1 is provided with the CPU 40 that controls the print device 1. A ROM 41, a RAM 42, a head drive portion 43, a main scan drive portion 44, a sub scan drive portion 45, the sensor 18, a display controller 48, and an operation processing portion 50 are electrically connected to the CPU 40 via a bus 39.

A control program, initial values and the like for the CPU 40 to control operations of the print device 1 are stored in the ROM 41. Various data used in the control program are temporarily stored in the RAM 42. The head drive portion 43 is electrically connected to the heads 110 that discharge the inks, and drives a piezoelectric element provided in each of discharge channels of the heads 110 (refer to FIG. 3) so as to cause the inks to be discharged from nozzles.

The main scan drive portion 44 includes the drive motor 19 (refer to FIG. 2) and causes the carriage 20 to move in the main scan direction. The sub scan drive portion 45 drives the platen drive mechanism 6 (refer to FIG. 2) and causes the platen unit 5 (refer to FIG. 1) to move in the sub scan direction. The sensor 18 can output, to the CPU 40, the detection signal that indicates that the position of the platen 51 in the intersecting direction is the second position, which is different from that of the first position. The display controller 48 controls a display of the display 49 in accordance with a command from the CPU 40. Various screens and messages regarding the operations of the print device 1 and the like are displayed on the display 49. The operation processing portion 50 accepts an operation input with respect to the operation buttons 46.

Print processing performed by the CPU 40 will be explained with reference to FIG. 12. The user can input a print start command for the print device 1 by depressing the operation buttons 46. When the CPU 40 detects that the print start command is input, the CPU 40 reads the program from the ROM 41 and performs the print processing. The print processing is processing in which the printing is performed on the print medium in accordance with print data specified by the user.

Figure 12:
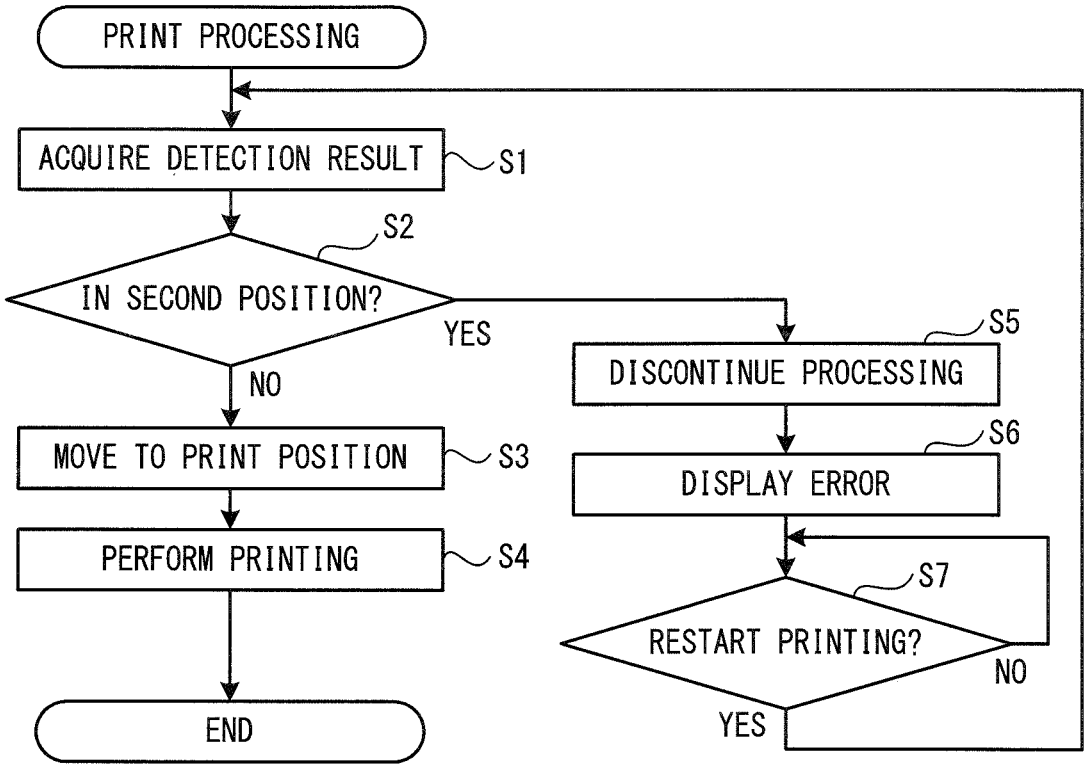
FIG. 12 is a flowchart of print processing.

As shown in FIG. 12, in the print processing, first, the CPU 40 obtains a detection result from the sensor 18 (step S1). The CPU 40 determines whether the platen 51 is in the second position on the basis of the detection result obtained at step S1 (step S2). At step S2, the CPU 40 causes the platen support base 13 to move in a direction from the set position toward the print position as required. When the printing is performed in a state in which the platen 51 is in the second position with respect to the mount portion 52, a print start position is displaced. The movement direction of the platen support base 13 of the present embodiment is the same as the slide direction of the platen 51. Therefore, if the first position and the second position is the same position with respect to the up-down direction, it is difficult to detect that the platen 51 is in the second position with respect to the mount portion 52 only with a sensor for detecting lifting and wrinkles of the print medium disposed on the platen 51. In the present embodiment, the second position is positioned further on the upper side than the first positon with respect to the up-down direction. As a result, the sensor 18, which is configured to detect the lifting and wrinkles of the print medium, is enabled to detect that the platen 51 is in the second position. The detection result is either that the CPU 40 has obtained the detection signal or that the CPU 40 has not obtained the detection signal. However, the sensor 18 may be provided separately from the sensor for detecting the lifting and wrinkles of the print medium. When the CPU 40 obtains the detection signal from the sensor 18 and detects that the platen 51 is in the second position (yes at step S2), the print processing that has been performed in accordance with the print start command is discontinued (step S5). The CPU 40 displays an error message on the display 49, for example (step S6). In the processing at step S6, the CPU 40 displays on the display 49 a message that informs the fact that the platen 51 is in the second position, for example. At step S6, the CPU 40 causes the platen support base 13 to move to the set position as required. The CPU 40 determines whether or not a command to restart the print processing has been obtained (step S7). The user can input the command for the print device 1 to restart the print processing by pressing the operation buttons 46. When the CPU 40 has not detected the command to restart the print processing (no at step S7), the CPU 40 stands by until the CPU 40 detects the command to restart the print processing. When the CPU 40 has detected the command to restart the print processing (yes at step S7), the CPU 40 returns the processing to step S1.

When the CPU 40 does not obtain the detection signal from the sensor 18 and the CPU 40 does not determine that the platen 51 is in the second position (no at step S2), the CPU 40 controls the sub scan drive portion 45 and causes the platen unit 5 to move from the set position to the print position (step S3). The CPU 40 controls the head drive portion 43, the main scan drive portion 44, and the sub scan drive portion 45 in accordance with the print data, and performs known print processing (step S4). The platen drive mechanism 6 is driven by the sub scan drive portion 45, and causes the platen support base 13 and the platen unit 5 to move in the sub scan direction along the pair of guide rails 11 and 12. The main scan drive portion 44 causes the carriage 20 to move in the main scan direction along the guide shaft 9. The heads 110 are driven by the head drive portion 43, and discharge the inks onto the print medium. The print device 1 performs the printing on the print medium as a result of the print medium mounted on the platen 51 being conveyed in the sub scan direction and the inks being discharged from the heads 110 that reciprocate in the main scan direction, in accordance with the print data. Then, the CPU 40 ends the print processing.

In the print device 1 described above, since the platen unit 5 has the connection portion 53, the position of the platen 51 can be changed between the first position and the second position with respect to the mount portion 52. In other words, the print device 1 can change an arrangement of the platen 51 with respect to the case 2. The print device 1 can make the gap between the platen 51 and the case 2 in the frontward direction larger than the gap obtained when the position of the platen 51 with respect to the mount portion 52 is in the first position, for example, by setting the position of the platen 51 with respect to the mount portion 52 of the platen unit 5 to be the second position. Therefore, compared with a print device of related art, in which the position of the platen 51 with respect to the mount portion 52 cannot be changed, the print device 1 can improve user-friendliness when the user places the print medium on or removes the print medium from the platen 51.

The mount portion 52 is removably mounted on the platen support base 13 that can move between the set position in which the print medium is placed on the platen 51 and the print position in which the printing is to be performed on the print medium placed on the platen 51. The connection portion 53 connects the mount portion 52 and the platen 51 such that the platen 51 can slide between the first position and the second position in the front-rear direction with respect to the mount portion 52. Therefore, the print device 1 can slide between the first position and the second position with respect to the mount portion 52, and can change the gap between the case 2 and the platen 51 in the frontward direction. Compared with the print device of related art in which the platen 51 cannot slide with respect to the mount portion 52, the print device 1 can improve the user-friendliness when the user places the print medium on or removes the print medium from the platen 51. Further, the print device 1 requires less space in the left-right direction when the position of the platen 51 is changed with respect to the mount portion 52, compared with a print device, which will be described below, and which can rotate a platen with respect to a mount portion.

The connection portion 53 is provided with the first fixed portion 61, the guide members 62 and 63, and the second fixed portion 64. The first fixed portion 61 has the grooves 76 to 79, which extend in the frontward direction, and is fixed to one of the mount portion 52 or the platen 51. The guide members 62 and 63 extend in the left-right direction. The guide member 62 is inserted into the grooves 76 and 78. The guide member 63 is inserted into the grooves 77 and 79. The guide members 62 and 63 guide the movement of the platen 51 with respect to the mount portion 52. The second fixed portion 64 supports the guide members 62 and 63 and is fixed to the other of the mount portion 52 or the platen 51. Therefore, since print device 1 is provided with the connection portion 53 that includes the first fixed portion 61, the guide members 62 and 63, and the second fixed portion 64, the platen 51 can slide between the first position and the second position with respect to the mount portion 52. The movement range between the first position and the second position can be adjusted by the length of the grooves 76 to 79 in the front-rear direction, for example.

The print device 1 is provided with the first energizing members 81 to 84, which energize the platen 51 in the downward direction when the position of the platen 51 with respect to the mount portion 52 is in the first position. Therefore, when the position of the platen 51 with respect to the mount portion 52 is the first position, the print device 1 can determine the position of the platen 51 with respect to the mount portion 52 in the downward direction. By performing the print processing when the position of the platen 51 with respect to the mount portion 52 is the first position, the print device 1 can reduce the possibility that the position of the platen 51 with respect to the mount portion 52 may change in the upward direction.

The first energizing members 81 and 83 energize the platen 51 in the downward direction by energizing the guide member 62 in the downward direction when the position of the platen 51 with respect to the mount portion 52 is the first position. The first energizing members 82 and 84 energize the platen 51 in the downward direction by energizing the guide member 63 in the downward direction when the position of the platen 51 with respect to the mount portion 52 is the first position. The guide members 62 and 63, which are energized in the downward direction, come into contact with the lower wall surfaces that form the grooves 76 to 79. Therefore, the print device 1 can more reliably determine the position of the platen 51 with respect to the mount portion 52 in the downward direction when the position of the platen 51 with respect to the mount portion 52 is the first position.

The print device 1 can inhibit the guide members 62 and 63 from sliding along the grooves 76 to 79. In other words, the print device 1 can inhibit the platen 51 from sliding in the front direction with respect to the mount portion 52 when the platen 51 is in the first position with respect to the mount portion 52. However, the first energizing members 81 and 84 may also energize the platen 51 in the rearward direction.

The first fixed portion 61 is provided with the grooves 76 and 77 that are lined up in the frontward direction. The first fixed portion 61 is provided with the grooves 78 and 79 that are lined up in the frontward direction. The guide members 62 and 63 are lined up so as to respectively correspond to the grooves 76 and 77 that are lined up in the frontward direction. The first energizing members 81 and 82 are lined up so as to respectively correspond to the guide members 62 and 63 that are lined up in the frontward direction. Therefore, the platen 51 can slide in the front-rear direction with respect to the mount portion 52 in a more stable manner than a platen of a print device of a first modified example in which a first fixed portion has a single groove in the front direction and a single guide member is provided. The print device 1 can more reliably determine the position of the mount portion 52 with respect to the platen 51 in the downward direction when the platen 51 is in the first position with respect to the mount portion 52 than the print device of the first modified example. The print device 1 can more reliably inhibit the guide members 62 and 63 from sliding along the grooves 76 to 79 when the platen 51 is in the first position with respect to the mount portion 52 than the print device of the first modified example.

The guide members 62 and 63 are rod members extending in the left-right direction. The first fixed portion 61 is provided with the grooves 76 and 78 that are lined up in the left-right direction. One end portion and the other end portion of the guide member 62 are respectively inserted into the grooves 76 and 78. The first energizing members 81 and 83 are lined up in the left-right direction so as to correspond to the one end portion and the other end portion of the guide member 62. The first fixed portion 61 is provided with the grooves 77 and 79 that are lined up in the left-right direction. One end portion and another end portion of the guide member 63 are respectively inserted into the grooves 77 and 79. The first energizing members 82 and 84 are lined up in the left-right direction so as to correspond to the one end portion and the other end portion of the guide member 63. The platen 51 can slide in the front-rear direction with respect to the mount portion 52 in a more stable manner than a platen of a print device of a second modified example in which a guide member is inserted into a single groove. The print device 1 can more reliably determine the position of the platen 51 with respect to the mount portion 52 in the left-right direction when the platen 51 is in the first position with respect to the mount portion 52 than the print device of the second modified example. The print device 1 can more reliably inhibit the guide members 62 and 63 from sliding along the grooves 76 to 79.

The print device 1 is provided with the second energizing members 85 and 86 that energize the platen 51 in the frontward direction when the position of the platen 51 with respect to the mount portion 52 is the second position. Therefore, the print device 1 can determine the position of the platen 51 with respect to the mount portion 52 in the frontward direction when the position of the platen 51 with respect to the mount portion 52 is the second position and can more reliably inhibit the platen 51 from sliding with respect to the mount portion 52. When the user performs the operation of placing the print medium on or removing the print medium from the mount portion 52 in the state in which the platen 51 is in the second position, the print device 1 can reduce the possibility of the platen 51 becoming unstable or tilted in the frontward direction with respect to the mount portion 52. Therefore, since the possibility of the platen 51 becoming unstable in the frontward direction with respect to the mount portion 52 can be reduced when the platen 51 is in the second position with respect to the mount portion 52, the print device 1 can improve the user-friendliness of the user at the time of placing the print medium on or removing the print medium from the platen 51.

The print device 1 is provided with the third energizing members 87 and 88 that energize the platen 51 in the left-right direction with respect to the mount portion 52 when the position of the platen 51 with respect to the mount portion 52 is the first position. Therefore, the print device 1 can energize the platen 51 in the left-right direction with respect to the mount portion 52 when the position of the platen 51 with respect to the mount portion 52 is the first position and can determine the position of the platen 51 in the left-right direction with respect to the mount portion 52. The print device 1 can reduce the possibility of the platen 51 becoming unstable or tilted in the left-right direction with respect to the mount portion 52 when the position of the platen 51 with respect to the mount portion 52 is the first position.

When the position of the platen 51 with respect to the mount portion 52 is the first position, the third energizing members 87 and 88 energize the platen 51 against the mount portion 52 by energizing the second fixed portion 64 in the left-right direction. Therefore, the print device 1 can determine the position of the platen 51 in the left-right direction with respect to the mount portion 52. The print device 1 can inhibit the guide members 62 and 63, which are supported by the second fixed portion 64, from sliding along the grooves 76 to 79, compared to a case in which the platen 51 is directly energized against the mount portion 52 in the left-right direction. In other words, when the platen 51 is in the first position with respect to the mount portion 52, by using the third energizing members 87 and 88, the print device 1 can inhibit the platen 51 from sliding in the front-rear direction with respect to the mount portion 52.

The third energizing members 87 and 88 are lined up in the front-rear direction. When the platen 51 is in the first position with respect to the mount portion 52, the print device 1 can more reliably determine the position of the platen 51 with respect to the mount portion 52 in the front-rear direction than a print device of a third modified example in which a single third energizing member is provided in the front-rear direction.

The third energizing members 87 and 88 are provided only on one side of the second fixed portion 64 in the left-right direction. In a print device of a fourth modified example in which third energizing members are provided on both one side and the other side of a second fixed portion in the left-right direction, the second fixed portion is energized by both of the third energizing members provided on the one side and the other side of the second fixed portion and easily oscillates between the third energizing members provided on the both sides. Therefore, in the fourth modified example, the position of the platen 51 with respect to the mount portion 52 becomes unstable in the left-right direction. Therefore, when the platen 51 is in the first position with respect to the mount portion 52, the print device 1 can more reliably determine the position of the platen 51 with respect to the mount portion 52 in the left-right direction than a print device of the fourth modified example.

The connection portion 53 connects the mount portion 52 and the platen 51 such that the platen 51 can slide between the first position and the second position with respect to the mount portion 52 in the front-rear direction. Therefore, in the print device 1, the gap between the case 2 and the platen 51 in the state in which the platen support base 13 is in the set position is larger when the platen 51 is in the second position with respect to the mount portion 52 than when the platen 51 is in the first position with respect to the mount portion 52. Therefore, the print device 1 can secure the gap between the platen 51 and the case 2 of the print device 1 and can improve the user-friendliness for the user when the print medium is placed on or removed from the platen 51.

In the print device of related art, a gap between a platen and a case is secured in a set position, in consideration of user-friendliness when the user places a print medium on or removes a print medium from the platen. With the print device of related art, there has been demand for a larger platen that enables printing to be performed on a larger area. On the other hand, there has been demand for keeping the overall size of the print device the same due to an installation space and so on. When the platen is enlarged in the frontward direction, since the print processing needs to be started from an enlarged frontward end of the platen, the movement range of the platen support base needs to be enlarged in the rearward direction. As a result, when the platen is enlarged in the frontward direction, the platen unit needs to be enlarged in the rearward direction. On the other hand, when the platen is enlarged in the rearward direction, since the front end position of the platen does not change with respect to the platen support base, there is no need to increase the movement range of the platen support base in the rearward direction. However, the gap between the platen and the case becomes narrower in the set position by the length by which the platen is enlarged in the rearward direction. The print device can cause the platen support base to move between a print position and the set position. Therefore, in the print device, even when the platen is enlarged in the rearward direction, if the enlargement length in the rear direction is shorter than the length from the print position to the set position, the rear end portion of the platen can be disposed below heads without changing the overall size of the print device. Meanwhile, in the print device 1 of the above-described embodiment, in the set position, the position of the platen 51 with respect to the mount portion 52 can be moved from the first position to the second position, namely, can be moved in the frontward direction. Therefore, the print device 1 does not need to secure the gap between the platen 51 and the case 2 in the state in which the platen support base 13 is in the set position and the platen 51 is in the first position with respect to the mount portion 52. Therefore, the print device 1 can position the rear end of the platen in a position further to the rear side than that of the print device of the related art and can make the length of the platen longer in the rear direction than that of the print device of the related art.

When the position of the platen 51 with respect to the mount portion 52 is in the first position in the state in which the platen support base 13 is in the set position, the connection portion 53 causes the rear end portion 511 of the platen 51 to be disposed inside the case 2. When the position of the platen 51 with respect to the mount portion 52 is the second position in the state in which the platen support base 13 is in the set position, the connection portion 53 causes the rear end portion 511 of the platen 51 to be disposed outside the case 2. The print device 1 can make the length of the platen longer in the frontward direction with respect to the size of the print device than a print device of a fifth modified example in which a rear end portion of a platen is disposed outside a case when the position of the platen with respect to a mount portion is in a first position. The print device 1 can improve the user-friendliness when the user places the print medium on or removes the print medium from the platen 51 compared with a print device of a sixth modified example in which a rear end portion of a platen is disposed inside a case when the position of the platen with respect to a mount portion is in a first position.

The connection portion 53 of the platen unit 5 connects the mount portion 52 and the platen 51 such that the position of the platen 51 can be changed between the first position and the second position, which have mutually different positions in the intersecting direction that intersects the first surface 54. When the printing is performed when the platen 51 is in the second position with respect to the mount portion 52, the print start position is displaced. In response to this, the sensor 18 can output to the CPU 40 the detection signal, which indicates that the platen 51 is in the second position, on the basis of the position of the platen 51 in the intersecting direction. Therefore, the print device 1 can determine whether the platen 51 is in the second position on the basis of the detection result of the sensor 18. The print device of related art is sometimes provided with the sensor that detects lifting from the platen and wrinkles of the print medium that is mounted on the platen. This sensor is either an infrared sensor or an optical sensor and detects the lifting or the wrinkles of the print medium by detecting whether or not there is any object above the height of the platen in the up-down direction. Therefore, in the print device 1 of the present embodiment, the position of the platen 51 in the up-down direction in the second position with respect to the mount portion 52 is set at a height that can be detected by the sensor of the related art. As a result, the print device 1 can utilize the above-described sensor and the like, which detects a placed state of the print medium, as the sensor 18 that detects whether the platen 51 is in the second position, and can thus detect whether or not the platen 51 is in the second position without the addition of any new member.

The grooves 76 to 79 of the first fixed portion 61 of the connection portion 53 are each provided with the inclined portion 69 extending in the frontward and intersecting directions and the straight line portion 68 extending in the frontward direction. The connection portion 53 connects the mount portion 52 and the platen 51 such that the platen 51 can slide between the first position and the second position, namely, in the frontward direction and in the intersecting direction with respect to the mount portion 52. Therefore, as a result of the guide members 62 and 63 moving along the grooves 76 to 79, the print device 1 can cause the platen 51 to slide both in the frontward direction and in the intersecting direction with respect to the mount portion 52.

A controller is electrically connected to the sensor 18. When the controller acquires the detection signal from the sensor 18, the controller discontinues the print processing that has been performed in accordance with the print start command. Therefore, the print device 1 can reliably inhibit the printing from being performed on the print medium in the state in which the platen 51 is in the second position.

The print device and the platen unit of the present disclosure are not limited to the above-described embodiment, and various modifications may be made thereto without departing from the spirit of the present disclosure. For example, modifications (A) and (B), which will be described below, may be implemented as appropriate.

(A) The configuration of the print device 1 may be changed as appropriate. It is sufficient that the print device 1 be provided with at least one head. The type of liquid discharged from the print device 1 may be changed as appropriate. The print device 1 need not necessarily be provided with a case. The sensor may be another detection device, such as an optical sensor disclosed in Japanese Patent No. 4089277, relevant portions of which are herein incorporated by reference.

(B) The configuration of the platen unit 5 may be changed as appropriate. For example, it is sufficient that the platen unit be able to change the position of the platen with respect to the mount portion. For example, the platen unit may be able to rotate the platen with respect to the mount portion by having a configuration in which the position of the rod 56 is changeable with respect to the rod 55 of the platen unit 5. In this case, the gap between the case 2 and the platen 51 can be changed by appropriately setting the rotation center and the rotatable range of the platen. The second position need not necessarily be positioned in the frontward direction with respect to the first position. When the platen 51 is in the first position with respect to the mount portion 52, the rear end portion of the platen 51 may be positioned further to the front side than the sensor 18.

The platen unit 5 may be removably supported by the platen support base 13 of the print device 1 or may be configured such that it cannot be removed once the platen unit 5 is supported by the platen support base 13. The connection portion need not necessarily be provided with the first fixed portion, the guide members, and the second fixed portion. For example, the first fixed portion may be integrally formed with the platen. The second fixed portion may be integrally formed with the mount portion. When the connection portion is provided with the first fixed portion, the guide members, and the second fixed portion, the shape, size, quantity, and arrangement of each of the portions and members may be changed as appropriate. For example, the guide members need not necessarily be the rod members. It is sufficient that at least one guide member be provided. For example, the guide member may be a pin supported by the second fixed portion. The grooves need not necessarily be the through-holes. The shape, size, quantity, and arrangement of the grooves may be changed as appropriate. A plurality of the guide members may be inserted into a single groove. A plurality of the grooves need not necessarily be lined up in the frontward direction. A plurality of the grooves need not necessarily be lined up in the left-right direction. The groove need not necessarily be provided with the inclined portion that extends in the front direction and in the intersecting direction. The inclined portion may be provided so as to extend only in the intersecting direction.

The platen unit 5 need not necessarily be provided with some or all of the first energizing members 81 to 84, the second energizing members 85 and 86, and the third energizing members 87 and 88. The configuration, shape, material, arrangement, and quantity of each of the first energizing members, the second energizing members, and the third energizing members may be changed as appropriate. For example, each of the first energizing members, the second energizing members, and the third energizing members may be an energizing member, such as a coil spring, other than the flat spring. Further, the first energizing members may energize a main body portion of the second fixed portion in the downward direction, and need not necessarily energize the guide members. A plurality of the first energizing members need not necessarily be lined up in the frontward direction. A plurality of the first energizing members need not necessarily be lined up in the left-right direction so as to correspond to the one end portions and the other end portions of the guide members in the left-right direction. The third energizing members 87 and 88 need not necessarily energize the second fixed portion 64, but may energize the platen 51 in the left-right direction when the position of the platen 51 with respect to the mount portion 52 is the first position. A plurality of the third energizing members need not necessarily be lined up in the frontward direction. The third energizing members may be provided on both sides of the second fixed portion 64 in the left-right direction. The platen unit may be one of the platen units of the above-described first to six modified examples. For example, the connection portion 53 need not necessarily cause the rear end portion 511 of the platen 51 to be disposed inside the case 2 when the position of the platen 51 with respect to the mount portion 52 is the first position in the state in which the platen support base 13 is in the set position. The connection portion 53 may cause the rear end portion 511 of the platen 51 to be disposed further to the front side than the sensor 18 when the position of the platen 51 with respect to the mount portion 52 is the first position in the state in which the platen support base 13 is in the set position. Similarly, the connection portion 53 need not necessarily cause the rear end portion 511 of the platen 51 to be disposed outside the case 2 when the position of the platen 51 with respect to the mount portion 52 is the second position in the state in which the platen support base 13 is in the set position.

In the print device, the sensor may be omitted. The print device need not necessarily be able to perform the print processing on the basis of the detection result of the sensor. Each of the steps of the print processing need not necessarily be performed by the CPU 40, as in the above example, and part or all of the steps may be performed by another electronic device (an ASIC, for example). Each of the above-described steps of the print processing may be performed by a plurality of electronic devices (a plurality of CPUs, for example) in a distributed manner. The order of the steps of the print processing may be changed as required. Also, some of the steps may be omitted, or a new step may be added. The scope of the present disclosure includes a case in which part or all of actual processing is performed by an operating system (OS), which operates in the print device 1, and the functions of the above-described embodiment are realized as a result of such processing. In the print processing, before obtaining the detection result, the print device may repeatedly obtain the detection result during a period between starting to move the platen support base 13 to the print position and when the platen support base 13 reaches the print start position. In this case, when it is determined that the platen 51 is in the second position on the basis of the detection signal from the sensor 18, the processing may be discontinued, and the platen support base 13 may be returned to the set position. In the above-described embodiment and modified examples, the frontward direction, the rearward direction, the left-right direction, and the downward direction of the print device 1 are, respectively, a first direction, a second direction, a third direction, and a fourth direction, but relationships between the print device and the first direction, the second direction, the third direction, and the fourth direction may be changed as appropriate in accordance with the configuration of the print device.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A platen unit comprising:

a platen having a surface on which a print medium is to be placed;

a mount portion mounted on a platen support portion provided in a print device; and a connection portion connecting the mount portion and the platen such that a position of the platen is slidable, with respect to the mount portion, between a first position and a second position in a first direction and in a second direction, the first direction being a direction along the surface of the platen, the second position being located in the first direction with respect to the first position, the second direction being a direction opposite to the first direction, wherein the connection portion is positioned at one side of the platen in a perpendicular direction with respect to the surface of the platen, the mount portion is fixed to the connection portion, the connection portion connects the mount portion and the platen such that the position of the platen is slidable, with respect to the mount portion fixed to the connection portion, between the first position and the second position, the mount portion having a rod portion extending in a perpendicular direction with respect to the surface of the platen, wherein a distance from the rod portion to a tip in the first direction of the platen located at the first position is shorter than a distance from the rod portion to the tip in the first direction of the platen located at the second position, and a distance from the rod portion to a tip in the second direction of the platen located at the first position is longer than a distance from the rod portion to the tip in the second direction of the platen located at the second position.

2. The platen unit according to claim 1, wherein a position of the surface of the platen located at the first position is a different position, in a perpendicular direction with respect to the surface of the platen, from a position of the surface of the platen located at the second position.

3. The platen unit according to claim 1, wherein the connection portion includes:

a first fixed portion fixed to one of the mount portion and the platen, the first fixed portion having a groove extending in the first direction;

a guide member configured to guide a movement of the platen with respect to the mount portion, the guide member extending in a third direction that intersects with the first direction, and the guide member being inserted into the groove; and a second fixed portion fixed to the other of the mount portion and the platen, the second fixed portion supporting the guide member.

4. The platen unit according to claim 3, wherein the groove of the first fixed portion includes a straight line portion and a inclined portion, the straight line portion extending in the first direction, the inclined portion extending in an intersecting direction that intersects the surface of the platen, and the guide member configured to guide the movement of the platen with respect to the mount portion along the groove.

5. The platen unit according to claim 3, further comprising:

a first energizing member configured to energize the platen in a fourth direction when the position of the platen with respect to the mount portion is the first position, the fourth direction being a direction parallel to a perpendicular direction with respect to the surface of the platen and a direction from the surface of the platen toward the mount portion, and wherein the mount portion is positioned at one side of the platen in the perpendicular direction with respect to the surface of the platen, the first fixed portion includes a plurality of the grooves lined up in the first direction, and the platen unit further includes:

a plurality of the guide members lined up so as to correspond to each of the plurality of grooves lined up in the first direction; and a plurality of the first energizing members lined up in the first direction so as to correspond to each of the plurality of the guide members lined up in the first direction.

6. The platen unit according to claim 5, wherein the guide member is a rod member extending in the third direction, one end portion and another end portion of the guide member being inserted, respectively, into the plurality of grooves lined up in the first direction, and the platen unit further includes a plurality of the first energizing members are lined up in the third direction so as to correspond to the one end portion and the other end portion of the guide member.

7. The platen unit according to claim 1, further comprising:

a first energizing member configured to energize the platen in a fourth direction when the position of the platen with respect to the mount portion is the first position, the fourth direction being a direction parallel to a perpendicular direction with respect to the surface of the platen and a direction from the surface of the platen toward the mount portion, and wherein the mount portion is positioned at one side of the platen in the perpendicular direction with respect to the surface of the platen.

8. The platen unit according to claim 7, wherein the first energizing member energizes the platen in the fourth direction by energizing the guide member in the fourth direction when the position of the platen with respect to the mount portion is the first position.

9. The platen unit according to claim 1, further comprising:

a second energizing member configured to energize the platen in the first direction when the position of the platen with respect to the mount portion is the second position.

10. The platen unit according to claim 1, wherein a position of the surface of the platen located at the first position is a different position, in a perpendicular direction with respect to the surface of the platen, from a position of the surface of the platen located at the second position.

11. The platen unit according to claim 1, wherein the connection portion includes:

a first fixed portion fixed to one of the mount portion and the platen, the first fixed portion having a groove extending in the first direction;

a guide member configured to guide a movement of the platen with respect to the mount portion, the guide member extending in a third direction that intersects with the first direction, and the guide member being inserted into the groove; and a second fixed portion fixed to the other of the mount portion and the platen, the second fixed portion supporting the guide member.

* * * * *